US008572780B1

(12) United States Patent
Watters

(10) Patent No.: US 8,572,780 B1
(45) Date of Patent: Nov. 5, 2013

(54) MULTI-USE THERAPEUTIC PILLOW

(76) Inventor: Bridget Watters, Sparks, NV (US)

( * ) Notice: Subject to any disclaimer, the term of this patent is extended or adjusted under 35 U.S.C. 154(b) by 102 days.

(21) Appl. No.: 13/558,816

(22) Filed: Jul. 26, 2012

(51) Int. Cl.
*A47G 9/10* (2006.01)

(52) U.S. Cl.
USPC ..... 5/638; 5/490; 5/636; 5/640; 5/644; 5/645

(58) Field of Classification Search
USPC ..... 5/638, 640, 644, 645, 490
See application file for complete search history.

(56) References Cited

U.S. PATENT DOCUMENTS

| | | | | | |
|---|---|---|---|---|---|
| 1,711,255 | A | * | 4/1929 | Weinman et al. | 267/117 |
| 1,777,477 | A | * | 10/1930 | Sampson | 5/655.3 |
| 2,688,142 | A | | 9/1954 | Jensen | |
| 3,089,153 | A | * | 5/1963 | Bosc | 5/710 |
| 3,124,812 | A | * | 3/1964 | Milton | 5/638 |
| 3,382,510 | A | | 5/1968 | Robinson | |
| 3,602,928 | A | | 9/1971 | Helzer | |
| 4,788,728 | A | * | 12/1988 | Lake | 5/636 |
| 5,351,348 | A | * | 10/1994 | Beger | 5/420 |
| 5,439,008 | A | * | 8/1995 | Bowman | 128/875 |
| 5,697,112 | A | * | 12/1997 | Colavito et al. | 5/633 |
| 6,292,964 | B1 | * | 9/2001 | Rose et al. | 5/630 |
| 6,499,166 | B1 | * | 12/2002 | Jones | 5/689 |
| 6,817,049 | B1 | | 11/2004 | Hall | |
| 6,993,800 | B2 | | 2/2006 | Greenawalt et al. | |
| 2006/0230539 | A1 | * | 10/2006 | Goodman | 5/660 |

FOREIGN PATENT DOCUMENTS

| | | | |
|---|---|---|---|
| FR | 2648999 | A1 | 1/1991 |

* cited by examiner

*Primary Examiner* — Robert G Santos
*Assistant Examiner* — Ifeolu Adeboyejo
(74) *Attorney, Agent, or Firm* — Wood, Herron & Evans, L.L.P.

(57) ABSTRACT

A multi-use therapeutic pillow for the head includes a cushioned frame having a central cavity that extends therethrough. A cushioned transverse member, operably coupled to the cushioned frame at its opposite ends, divides the central cavity into a lower cavity and an upper cavity. The lower cavity is larger than the upper cavity. In use, the multi-use therapeutic pillow is configured to protect and/or avoid contact with a sensitive anatomical structure, such as, the eyes, ears, nose, or mouth, while providing adequate support for the head.

20 Claims, 6 Drawing Sheets

MULTI-USE THERAPEUTIC PILLOW

FIELD OF THE INVENTION

The present invention relates generally to therapeutic pillows and, more particularly, to therapeutic pillows designed to permit a user's head to be oriented differently with respect to the pillow to protect and/or avoid contact with sensitive anatomical structure of the user's head, such as, the user's eyes, ears, nose, or mouth, thereby enhancing the user's comfort and/or promoting healing of the aforesaid anatomical structures.

BACKGROUND OF THE INVENTION

Pillows are commercially-available in a wide range of shapes and sizes, each fulfilling a particular role. While pillows are primarily used to support the head of a resting or sleeping individual, some pillows are configured to support the other parts of the body (for example, the knees), and others are primarily for decorative purposes only. One class of pillows, e.g., orthopedic pillows, is constructed to support a particular body position, such as to correct vertebral alignment, support the head and neck during travel, or to relieve a particular condition, such as sleep apnea, snoring, sciatica pain, whiplash, rotator cuff injury, or gastroesophageal reflux disease ("GERD").

Despite the variety of known, conventional pillows, there remains a need for providing complete support to a user's head while protecting an injured or sensitive anatomical region thereof, such as, an eye, ear, nose, mouth, etc. Users apply the full weight of the head onto the pillow when resting or sleeping, which may lead to painful contact between the pillow and an injury or an area of sensitivity of the user's head. Thus, there remains a need for a therapeutic pillow that is configured to protect, or selectively avoid contact with, sensitive anatomical structures of a user's head, while providing the necessary support to the head of a resting or sleeping individual.

SUMMARY OF THE INVENTION

The present invention addresses the foregoing problems and other shortcomings and drawbacks of conventional therapeutic pillows for supporting the head. While the invention will be described in connection with certain embodiments, it will be understood that the invention is not limited to these embodiments. To the contrary, this invention includes all alternatives, modifications, and equivalents as may be included within the scope of the present invention.

According to one embodiment of the present invention, a multi-use therapeutic pillow for supporting a user's head while protecting and/or avoiding contact with a selected sensitive portion thereof includes a cushioned frame having a central cavity extending therethrough. A cushioned, transverse member is operably coupled to the cushioned frame and divides the central cavity into upper and lower cavity sections such that the lower cavity section is larger than the upper cavity section.

In one aspect, the upper and lower cavity sections of the multi-use therapeutic pillow may be through holes; other aspects may include first and second membrane extending across the upper and lower cavity sections.

Another embodiment of the present invention is directed to a multi-use therapeutic pillow for supporting the user's head while protecting and/or avoiding contact with a selected portion thereof that includes a cushioned frame having a central cavity extending therethrough. A cushioned, transverse member is operably coupled to the cushioned frame and divides the central cavity into differently sized lower cavity and upper cavities. First and second membranes extend across respective ones of the differently sized cavities and are configured to increase the structural integrity of the cushioned frame of the multi-use therapeutic pillow.

In accordance with another embodiment of the present invention, a method of using a multi-use therapeutic pillow for supporting the head is described. The multi-use therapeutic pillow includes a cushioned frame having a central cavity, which is further divided into differently sized upper and lower cavities by a cushioned, transverse member, the lower cavity being larger than the upper cavity. The method includes positioning a sensitive anatomical portion of the head proximate a selected one of the upper and lower cavities and resting the head on the pillow with the sensitive anatomical portion thereof overlying or received by the selected cavity.

The above and other objects and advantages of the present invention shall be made apparent from the accompanying drawings and the descriptions thereof.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION

Figure 1:
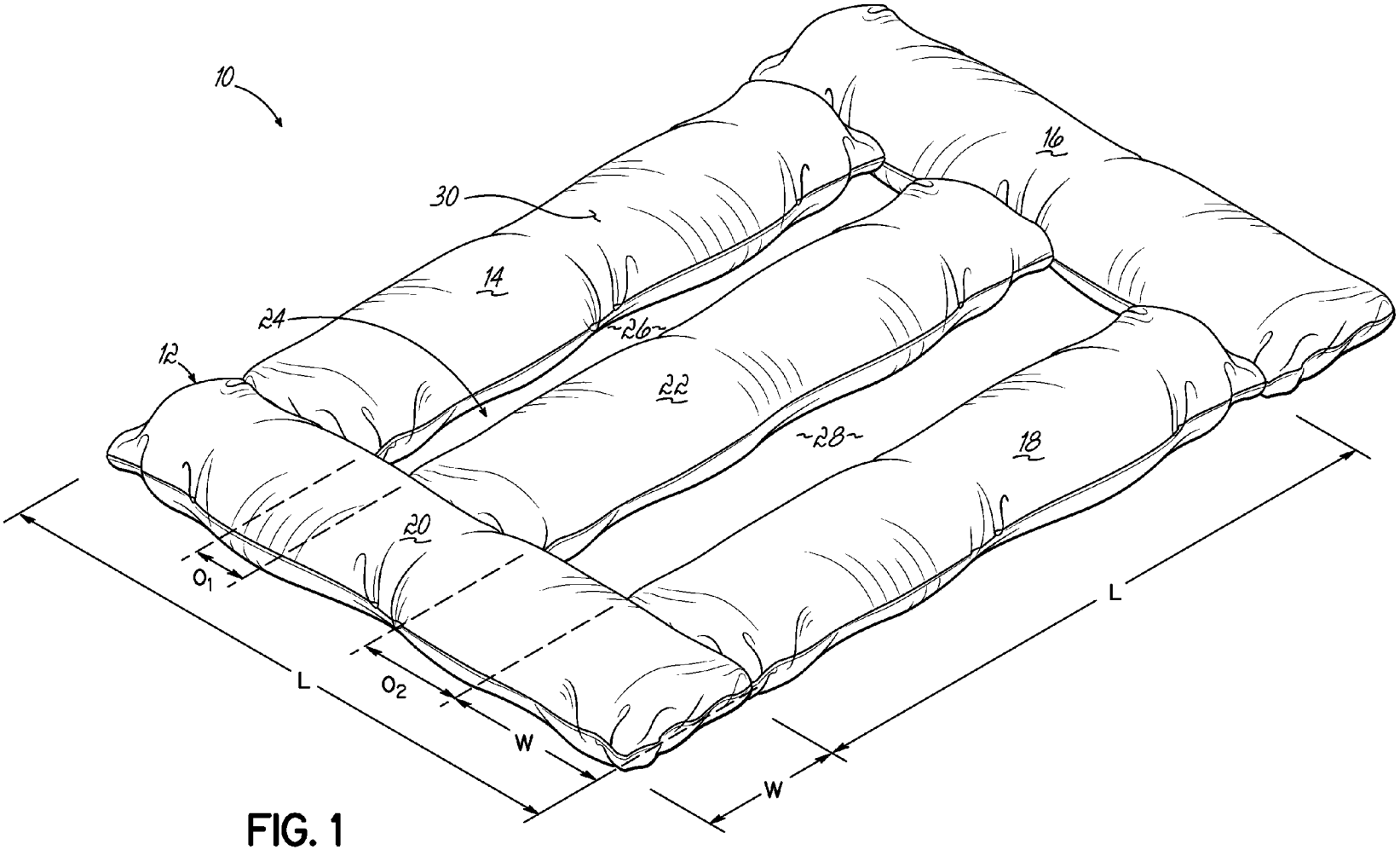
FIG. 1 is a perspective view of a pillow in accordance with one embodiment of the present invention.

Turning now to the figures, and in particular to FIG. 1, a pillow 10 in accordance with one embodiment of the present invention is shown. The pillow 10 includes a cushioned frame 12 that, as shown in the particular illustrative embodiment, includes a plurality of tubular segments 14, 16, 18, 20, 22. For the purpose of reducing the number of differently sized parts, although not necessary, each segment 14, 16, 18, 20, 22 is shown to have closed ends and a sidewall extending between the closed ends such that each segment 14, 16, 18, 20, 22 defines similar dimensions, including, for example, a length (L), preferably approximately 11⅝ inch, and a width (W) or diameter, preferably approximately 2⅞ inch. Four of the segments 14, 16, 18, 20 may be arranged in a generally rectangular-shape, forming a central cavity 24 therein. The fifth segment 22 (also referred to as a cushioned, transverse member) may be positioned within the large central cavity 24 so as to divide the same into upper and lower sized cavities 26, 28 having different dimensions $O_1$ and $O_2$ (also referred to as fixed spacings between the joints formed between the closed ends of the corresponding segments 14, 18, 22 and the sidewalls of the other segments 16, 20), respectively, which in the preferred embodiment are approximately 1.5 inches and 3 inches. Off-center placement of the fifth segment 22 within the central cavity 24 provides the lower cavity 28 with an area (when viewed in top plan) that is greater than the area of the upper cavity 26.

Figure 1A:
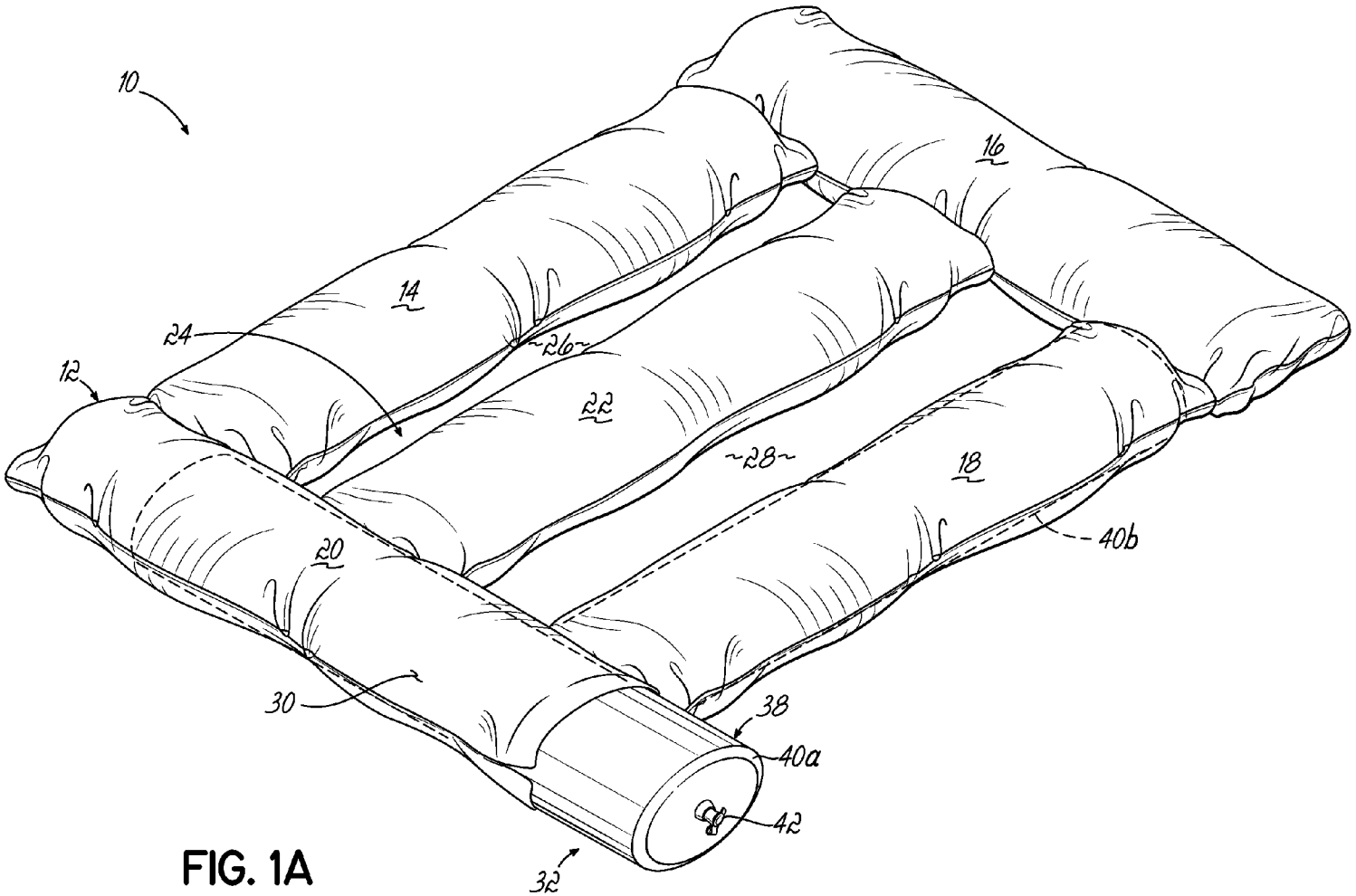
FIG. 1A is a perspective view of a fabric shell and a resilient filler comprising the pillow of FIG. 1 in accordance with another embodiment of the present invention.

The cushioned frame 12 of the pillow 10 may comprise a shell 30 and a resilient filler 32. As shown in FIG. 1A, the shell 30 may include a fabric-based construction, the selection of fabric being based on a desired use of the pillow 10. For example, the shell 30 of pillows 10 that may contact the skin 34 of the user's face 36 may include satin so as to lessen skin wrinkling. The shell 30 of pillows 10 intended for multiple users, such as in a healthcare facility or hotel, may be constructed from a durable and/or washable material, such as cotton, nylon, denim, polyester, or linen. These materials and others may include a pre-treatment to further improve stain resistance, water resistance, or to introduce antibiotic properties.

Generally speaking, the resilient filler 32 may comprise any material or structure configured to be inserted into the shell 30 so as to provide the desired level of support or a degree of compressibility. Conventional pillows are marketed as being soft, medium, or firm, which are generalized terms for describing the level of support offered by that particular pillow. Therefore, the type and/or amount of resilient filler 32 used with the shell 30 may be selected to yield the desired level of support. Filler materials may include natural and/or synthetic materials, including, for example, cotton, down, feathers, buckwheat hulls, hemp fill, foam, latex, or polyester. Alternatively, and as was shown in FIG. 1A, the resilient filler 32 may be an inflatable bladder 38 comprising a plurality of tubes 40*a*, 40*b* of one or more sizes. Each of the plurality of tubes 40*a*, 40*b* may be separately inflated via air valves 42 and inserted into the shell 30. The tubes 40*a*, 40*b* may be, alternatively, fluidically coupled, with one or more air valves 42 operable for inflation. While fluidically-coupling the tubes 40*a*, 40*b* provides ease of inflation, individual inflation of each tube 40*a*, 40*b* permits variable levels of support within the same pillow 10. Individual inflation of each tube also eliminates the movement of air from an area of compression (such as while supporting the user's head) to an area of less compression, which may result in an undesirable and/or uneven amount of support.

In any event, the inflatable bladder 38 may be constructed from vinyl, polyvinyl chloride, polyester, and polyurethane, for example.

Although not shown, it would be readily appreciated from the disclosure provided herein that pillows constructed in accordance with one or more embodiments of the present invention need not be limited to a two-piece construction. Instead, pillows that include an inflatable bladder may include a unitary construction, wherein at least one outer surface of the inflatable bladder includes a velour-flocked vinyl. In this way, the pillow retains the inflatable nature, provides softness and comfort to the user, and eliminates the separate component of a shell.

Referring still to FIGS. 1 and 1A, and in lieu of the inflatable bladders 38, the resilient filler 32 may include compressible material having a particular shape, such as tubes, or rods, suitable for use with the shell 30. The compressible material may be, for example, polyester fiberfill, foam, or other like material. Furthermore, these or other materials may be used to stuff, or otherwise fill, bladders for insertion into the shell 30, or into the shell 30 directly. Another alternative to constructing the pillow 10 of multiple stuffed tubes, is to provide a single block of appropriate density foam and provide the cavities 24 and 28 by selective removal of foam material from the block. A still further alternative is to foam the pillow in place in a two-part mold, and when the foam has cured, open the mold and remove the molded pillow.

Figure 2:
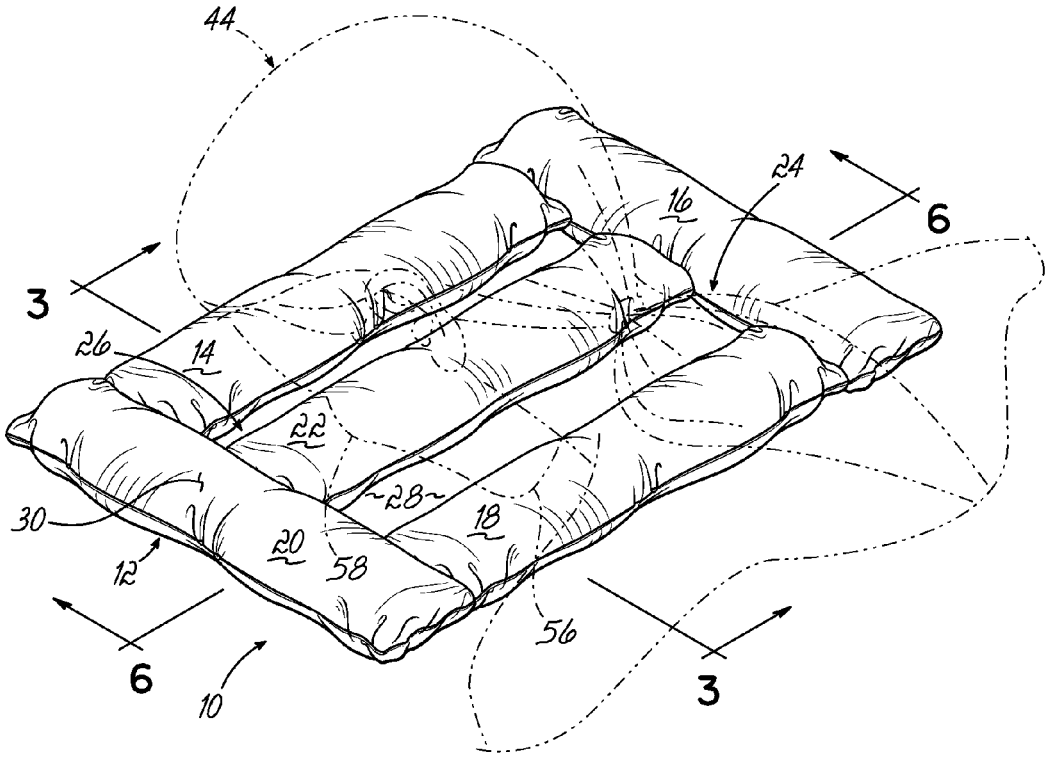
FIG. 2 is another perspective view of the pillow of FIG. 1, with a user, shown in phantom, in a prone position such that the user's eyes overlie or fall within an upper cavity of the pillow and the user's lips overlie or fall within a lower cavity of the pillow.

Given the details of the pillow 10 as shown in FIGS. 1 and 1A, and with reference now to FIG. 2, use of the pillow 10 is described in accordance to one embodiment of the present invention. The user 44, shown to be face down, has positioned the pillow 10 such that the eyes 46 overlie or fall within the upper cavity 26 and the lips 48 overlie or fall within the lower cavity 28. The particular positioning is shown in greater detail in FIG. 3. The illustrative position may be particularly useful for the user 44 wishing to avoid contact between their eyes 46 and the pillow 10, such as those users having an eye irritation (such as allergies), eye infection (such as a stye), or post-operative recovery (such as after the removal of cataracts). Similar use can be made for users 44 having concerns regarding the mouth and/or lips (such as placement of braces, cold sores, or lip augmentation). In either situation, for the user 14 that prefers to rest face down, pressure applied to the sensitive facial structure may be limited or eliminated altogether. Therefore, and in use, the user 44 may position that sensitive facial structure to overlie or fall within a selected one of the upper and lower cavity 26, 28 and such that the cushioned frame 12 provides protection and support to less sensitive areas of the face, head, and neck.

Figure 3:
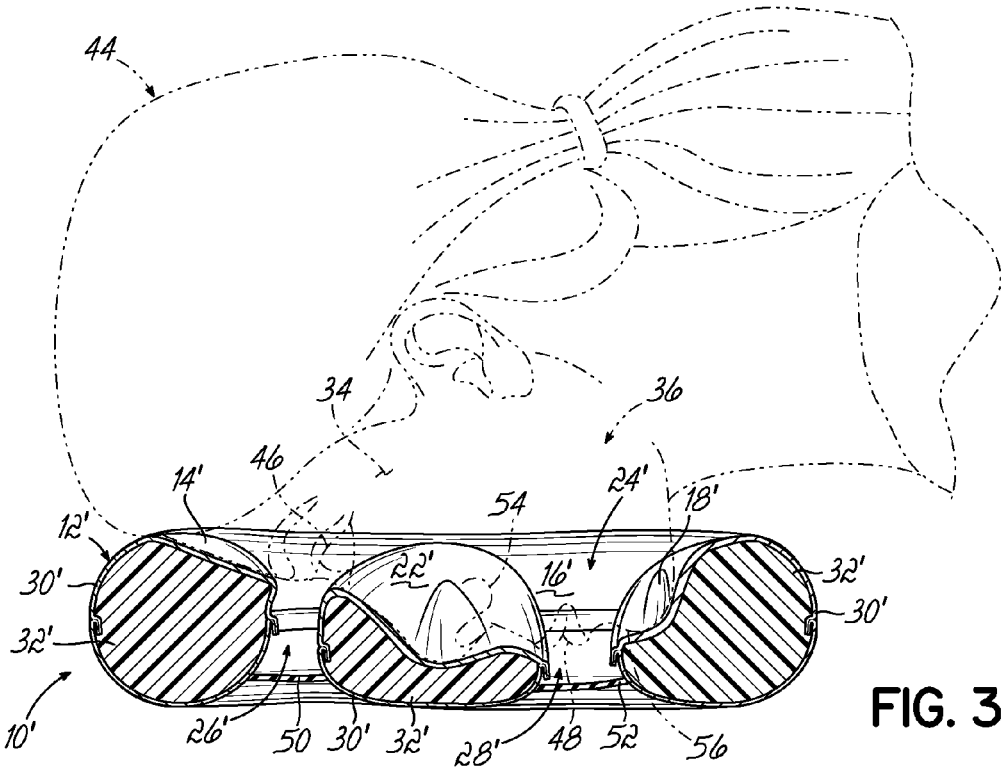
FIG. 3 is a cross-sectional view of the pillow, taken along the Line 3-3 of FIG. 2, with the user shown, facedown, in phantom.

In FIG. 3, like FIG. 2, the user 44 positions the pillow 10' such that the eyes 46 and lips 48 overlie or fall within the upper and lower cavities 26', 28', respectively. However, as compared to the cavities 26, 28 of FIG. 2, the pillow 10' of FIG. 3 further includes first and second membranes 50, 52 extending across the bottom of the respective upper and lower cavities 26', 28'. The membranes 50, 52 are configured to increase the structural integrity of the cushioned frame 12' and may be constructed from materials that are similar to those described previously for the shell 30', but are generally inelastic in nature so as to limit internal shifting of the shell 30' with respect to the resilient filler 32' or the cushioned frame 12' generally. The membranes 50, 52 close the upper and lower cavities 26', 28' to form recesses and may be placed at any location within the respective cavities 26', 28'; however, it may be desirable to position the membranes 50, 52 offset with respect to a central plane through the pillow 10' to increase a depth of the recess for receiving the sensitive facial structures.

The skilled artisan will readily appreciate that the membranes 50, 52 may be constructed from the same material and, in fact, the same cut sheet of material, as the shell 30' or, alternatively, from another material and/or cut sheet of fabric that is then coupled to the shell 30' via stitching, heat fusion tape, buttons, hooks, or other known devices.

Figure 4:
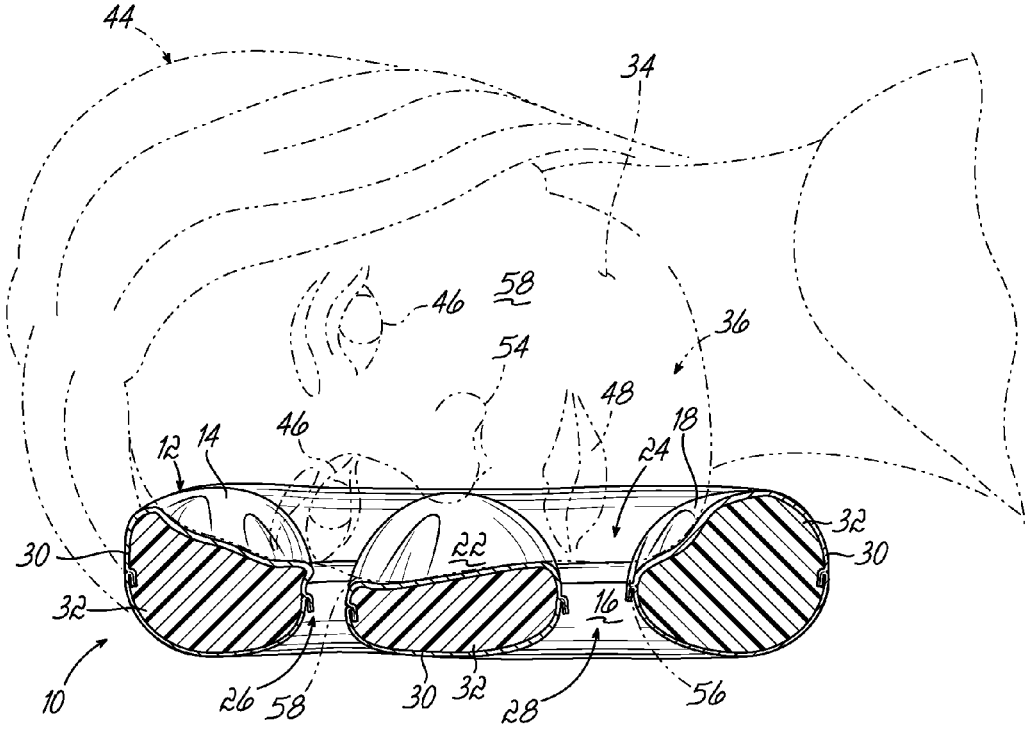
FIG. 4 is a cross-sectional view of the pillow, taken along Line 3-3 of FIG. 2 but with the user shown in a prone position with head turned such that the face is directed to the side.

Turning now to FIG. 4, the pillow 10 is position similar to the arrangement shown previously, but the user's head is rotated. Therefore, the user 44 need not be limited to a face down position, but instead may move and shift, during rest, while eliminating pressure to those sensitive facial structures.

Figure 5:
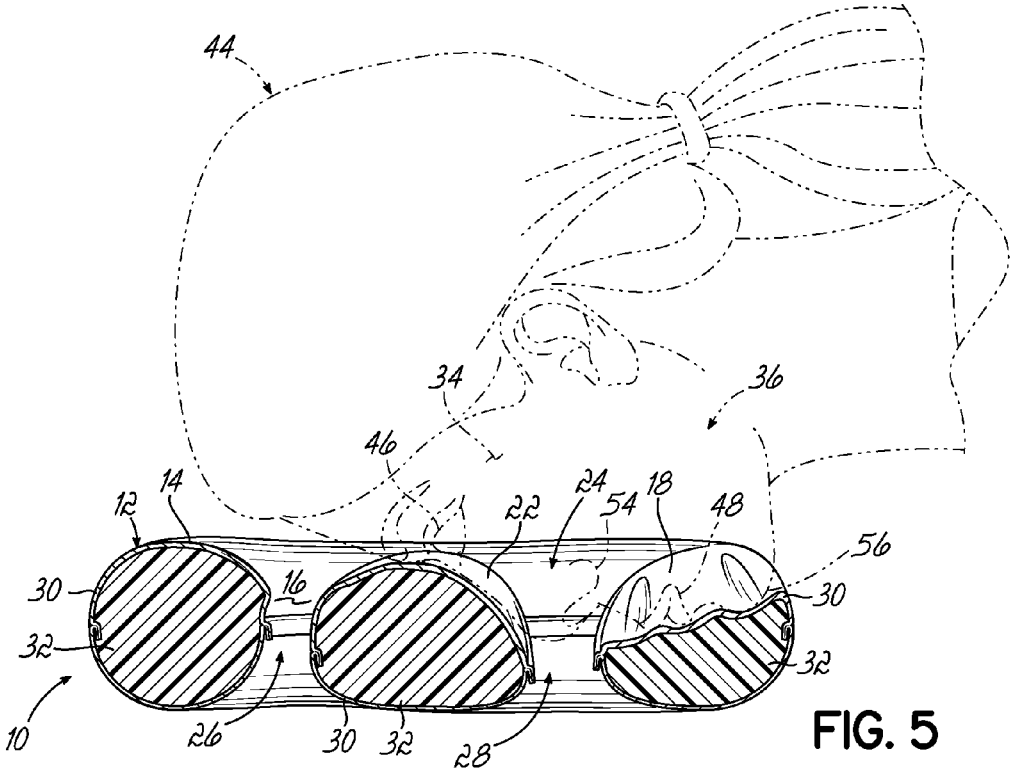
FIG. 5 is a cross-sectional view of the pillow, taken along the Line 3-3 of FIG. 2, with the user shown in phantom such that the user's nose falls within the lower cavity of the pillow.

Of course, use of the pillow 10 need not be limited to reducing pressure applied to eyes 46 and lips 48. In fact, and in other uses such as is shown in FIG. 5, the pillow 10 may also be positioned such that the user's nose 54 falls within one of the upper and lower cavities 26, 28. Similarly, and as depicted in FIG. 5, an adult recovering from a sinus surgery may position the pillow 10 such that his/her nose, maxillary sinus, and/or ethmoidal sinus fall within the larger, lower cavity 28. In either situation, the user 44 may rest, face down or with the head rotated to one side, while reducing the amount of pressure applied to the sensitive facial structures. This particularly illustrated position may also be useful for relieving pressure applied to the ear, which may be sensitive due to ear infection or after ear piercing, ear surgery, for example. To accomplish this result, the user's head would be rotated 90° from that shown in FIG. 5 such as to position the ear to overlie the lower cavity 28. For example, although not shown in FIG. 5, a child having suffered a sports-related nose injury may position the pillow 10 such that his/her nose falls within the smaller, upper cavity 26.

Figure 6:
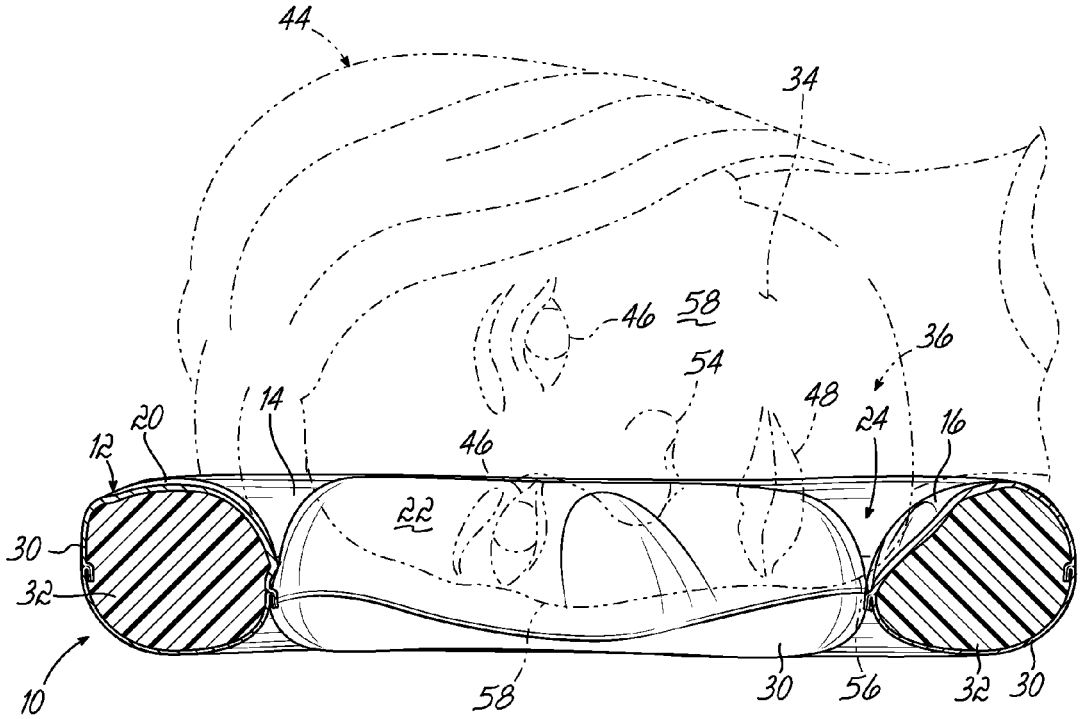
FIG. 6 is a cross-sectional view of the pillow, taken along the Line 6-6 of FIG. 2, with the user shown in the prone position.

As alluded to previously, pillows according to embodiments of the present invention may also provide cosmetic benefits. In particular, it has been recognized that pillows may contribute to the appearance of aging and, in particular, to wrinkle formation. According to one hypothesis, pressure applied by the pillow onto the delicate tissues of the face, night-after-night, may etch lines, called sleep lines, within the dermal and epidermal layers of the skin. In that regard, and with reference now to FIG. 6, the pillow 10 may also be used in reducing the appearance of wrinkles The pillow 10, shown in cross-section, is rotated approximately 90° (as compared to FIG. 3) such that the user's chin 56 and cheek 58 fall within the larger lower cavity 28. As a result, the cushioned frame 12 supports the back of the user's head while pressure applied to the facial structures (here the chin 56 and cheek 58) is reduced or eliminated. By constructing the pillow 10 from nonabrasive materials, such as silk or satin, the delicate tissues of the face may be further protected from the appearance of sleep lines.

Although not specifically depicted in the figures herein, the pillow 10 may also be used to reduce muffling of sound, which is common when using conventional pillows. That is, the user 44 may position the pillow 10 such that the ear falls within one of the upper or lower cavities 26, 28. Without obstruction from the pillow, the user 44 may be able to hear noises that would otherwise be muffled or muted by contact between the ear and a conventional pillow. Such uses may be advantageous for users that are on alert, for example, a new parent listening for the cry of an infant or first responders listening for an alarm, telephone, pager, or other audible signal. The pillow 10 used in this manner could also provide relief to users having a hearing deficit that wish to rest while watching television or listening to music.

Figure 7A:
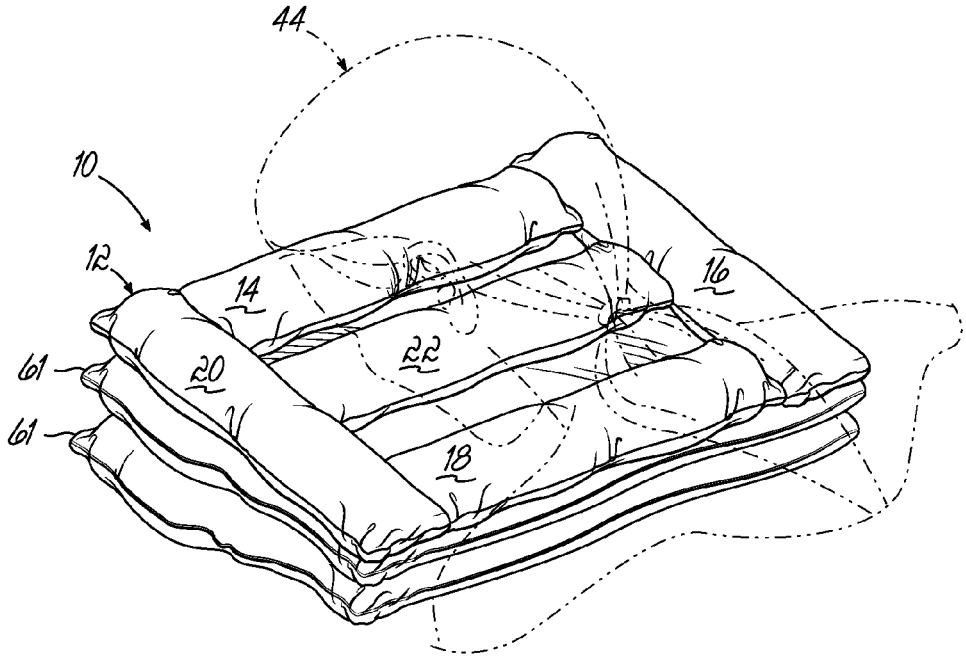
FIG. 7A is a perspective view of another embodiment of the present invention.

Pillows in accordance with embodiments of the present invention may also be useful in alleviating the nighttime symptoms of acid reflux and/or gastroesophageal reflux disorder ("GERD"). In particular, users having either of these disorders have found at least partial relief by elevating their head while at rest. In that regard, the pillow 10 may be stacked with one or more other, conventional pillows 61, as shown in FIG. 7A. In this way, the user 44 retains the benefits of the pillow 10 noted above (whether protecting sensitive facial structures or cosmetic purposes) while one or more conventional pillows 61 provide a desired or therapeutic height.

Figure 7B:
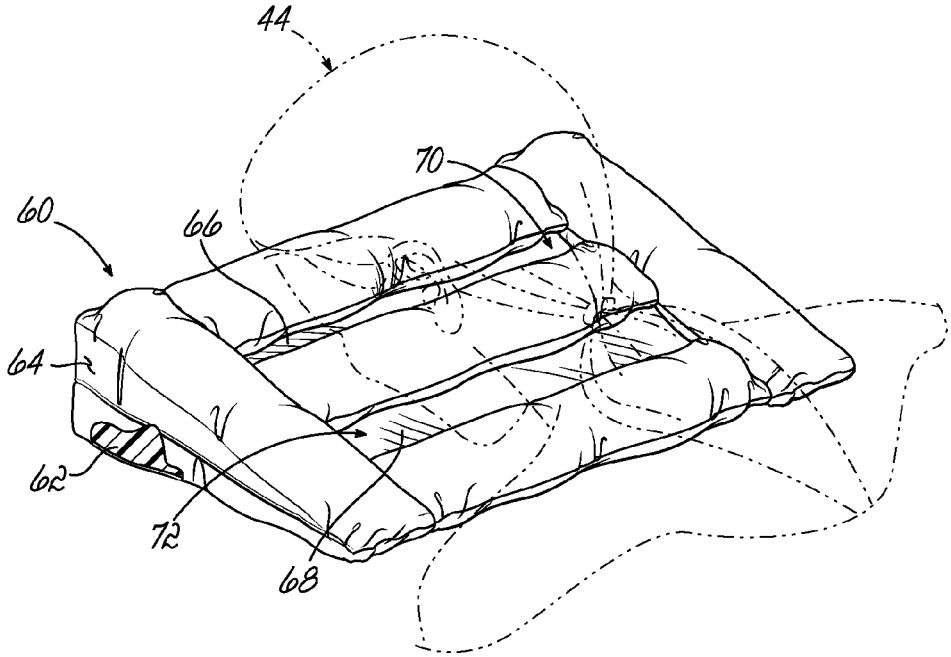
FIG. 7B is a perspective view of another embodiment of the present invention.

In FIG. 7B, a pillow 60 in accordance with another embodiment of the present invention is shown for use in reducing the nighttime symptoms of acid reflux and/or GERD. The resilient filler 62 of the pillow 60 includes a shape that is similar to commercially-available wedge pillows, so as to naturally incline the user's head. The shell 64 of the pillow 60 may be constructed, as described previously, including first and second membranes 66, 68 in upper and lower cavities 70, 72. The membranes 66, 68 resist damage to the filler 62 and/or maintain cleanliness of the filler 62.

It would be readily appreciated that the pillow 10 may comprise an integral block of any desired compressible material, such as foam, from which material the block has been removed to form the differently sized cavities 26 and 28.

In that same regard, pillows according to other embodiments of the present invention, may be constructed to include a cushioned frame shape that when viewed in top plan is generally oval, trapezoidal, square, or other geometric shape as desired for a particular therapeutic purpose. Furthermore, the overall size of the pillow may vary, that is, larger pillows may be constructed for use with a king size bed while smaller pillows may be constructed for therapeutic treatment of infants.

The combination of a cushioned frame, regardless of its geometric shape, forming a large central cavity and a transverse cushioned member spanning the frame cavity to divide it into two differently sized cavities, provides a therapeutic pillow which is susceptive of supporting the entire head in a variety of different orientations, while protecting and avoiding contact with a variety of different potentially sensitive anatomical components of the user's head.

While the present invention has been illustrated by a description of various embodiments, and while these embodiments have been described in some detail, they are not intended to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with methods of practicing the present invention as currently known. However, the invention itself should only be defined by the appended claims.

What is claimed is:

1. A multi-use therapeutic pillow which is susceptive of supporting a user's entire head in a variety of different presentations, while protecting and avoiding contact with a variety of different potentially sensitive anatomical components of the user's head, such as the user's eyes, ears, nose, lips, cheek, and chin, the pillow comprising:

a cushioned frame having opposite ends and a central cavity therein, the cushioned frame including spaced-apart left side and right side cushioned members at the opposite ends and between which extend and are coupled thereto upper and lower cushioned members spaced from and on opposite sides of the central cavity; and a cushioned transverse member operably coupled to the left side and right side cushioned members of the cushioned frame at the opposite ends and dividing the central cavity into a lower cavity and an upper cavity, the lower cavity being larger than the upper cavity, such that the upper cavity is sized to receive a first type of sensitive anatomical components of the user's head and the lower cavity is sized to receive a second type of sensitive anatomical components of the user's head larger than the first type of sensitive anatomical components when the user's head is entirely supported by the cushioned frame and the cushioned transverse member, wherein each of the left side and right side cushioned members, the upper and lower cushioned members, and the cushioned transverse member includes closed ends and a sidewall extending between the closed ends to define an elongate shape, and the closed ends of the upper and lower cushioned members and of the cushioned transverse member are fixed to the sidewalls of the left side and right side cushioned members such that the upper and lower cavities extend between the sidewalls of the left side and right side cushioned members, and the lower cavity is larger than the upper cavity as a result of a first fixed spacing defined between the closed ends of the lower cushioned member and the cushioned transverse member being larger as compared to a second fixed spacing defined between the closed ends of the upper cushioned member and the cushioned transverse member.

2. The multi-use therapeutic pillow of claim 1, wherein the cushioned frame includes a flexible shell and a resilient filler.

3. The multi-use therapeutic pillow of claim 2, wherein the resilient filler includes at least one of an inflatable bladder, cotton, down, feathers, buckwheat hulls, hemp fill, foam, latex, polyester, or a combination of two or more thereof.

4. The multi-use therapeutic pillow of claim 1, wherein the cushioned frame and cushioned transverse member comprise a block of compressible material from which compressible material has been removed to produce the upper and lower cavities and to produce the left side and right side cushioned members, the upper and lower cushioned members, and the cushioned transverse member, the block including the closed ends and the sidewalls of the members.

5. The multi-use therapeutic pillow of claim 1, further including a wedge-configured cushion underlying the cushioned frame and cushioned transverse member to incline the head of the user while at rest or while at sleep.

6. The multi-use therapeutic pillow of claim 1, wherein the cushioned frame and cushioned transverse member include a shell comprising at least one of silk, satin, nylon, denim, polyester, linen, and velour-flocked vinyl.

7. The multi-use therapeutic pillow of claim 1, wherein the cushioned frame and cushioned transverse member include an outer surface formed from at least one of silk and satin to further reduce the appearance of sleep lines on a face of the user.

8. The multi-use therapeutic pillow of claim 1, wherein the upper and lower cavities are through openings.

9. The multi-use therapeutic pillow of claim 1, further comprising:

a first membrane section extending across the lower cavity; and a second membrane section extending across the upper cavity, wherein the first and second membrane sections increase the structural integrity of the pillow.

10. The multi-use therapeutic pillow of claim 1, wherein the lower cavity is approximately twice as large as the upper cavity.

11. The multi-use therapeutic pillow of claim 1, further including one or more conventional pillows underlying the cushioned frame and cushioned transverse member for additionally alleviating the nighttime symptoms of acid reflux and/or gastroesophageal reflux disorder.

12. The multi-use therapeutic pillow of claim 1, further including a wedge-shaped pillow underlying the cushioned frame and cushioned transverse member for additionally reducing the nighttime symptoms of acid reflux and/or gastroesophageal reflux disorder.

13. A method of using a multi-use therapeutic pillow, the multi-use therapeutic pillow comprising a cushioned frame having opposite ends and a central cavity therein, and a cushioned transverse member operably coupled to the cushioned frame at the opposite ends and dividing the central cavity into a lower cavity and an upper cavity, the lower cavity being larger than the upper cavity, the method comprising:

positioning a first type of sensitive anatomical components of a user's head proximate a selected one of the upper and lower cavities, a size of the selected one of the upper and lower cavities being greater than a size of the first type of sensitive anatomical components;

resting the user's head entirely on the cushioned frame and the cushioned transverse member such that the first type of sensitive anatomical components is received by the selected one of the upper and lower cavities; and repositioning the therapeutic pillow relative to the user's head such that a second type of sensitive anatomical components of the user's head larger than the first type of sensitive anatomical components is received in the other of the upper and lower cavities while the user's head rests entirely on the cushioned frame and the cushioned transverse member, a size of the other of the upper and lower cavities being greater than a size of the second type of sensitive anatomical components.

14. The method of claim 13, wherein the selected one of the upper and lower cavities is the lower cavity when the size of the first type of sensitive anatomical components is greater than the size of the upper cavity.

15. The method of claim 13, wherein the cushioned frame includes a fixed-shape periphery surrounding the central cavity such that the central cavity defines a fixed shape and size for use when receiving sensitive anatomical components of the user within one of the upper and lower cavities.

16. The method of claim 13, wherein the cushioned frame includes spaced-apart left side and right side cushioned members at the opposite ends and between which extend and are coupled thereto upper and lower cushioned members spaced from and on opposite sides of the cushioned transverse member, each of the left side and right side cushioned members, the upper and lower cushioned members, and the cushioned transverse member includes closed ends and a sidewall extending between the closed ends, and the closed ends of the upper and lower cushioned members and of the cushioned transverse member are fixed to the sidewalls of the left side and right side cushioned members to define joints between the left side and right side cushioned members and other cushioned members, and the method further comprises:

repositioning the therapeutic pillow at the joints relative to the user's head such that the first or second type of sensitive anatomical components is completely received in the upper or lower cavities when the user's head is moved to a different resting position supported on top of the cushioned frame and the cushioned transverse member.

17. The method of claim 13, further comprising:

positioning at least one of a conventional pillow and a wedge-shaped pillow to underlie the cushioned frame and cushioned transverse member, thereby providing a reduction in the nighttime symptoms of acid reflux and/or gastroesophageal reflux disorder for the user.

18. The method of claim 13, wherein resting the user's head entirely on the cushioned frame and the cushioned transverse member further comprises:

contacting the user's head with an outer surface of the cushioned frame and the cushioned transverse member, the outer surface formed from at least one of silk and satin to further reduce the appearance of sleep lines on a face of the user.

19. The multi-use therapeutic pillow of claim 1, wherein the cushioned frame defines a fixed-shape periphery surrounding the central cavity such that the central cavity defines a fixed shape and size.

20. The multi-use therapeutic pillow of claim 1, wherein the fixing between the sidewalls of the left side and right side cushioned members and the closed ends of the upper and lower cushioned members and the cushioned transverse member defines joints between the left side and right side cushioned members and other cushioned members, the joints configured to enable repositioning of the left side and right side cushioned members relative to a user's head to ensure that sensitive anatomical components of the user's head may be accurately received in the upper or lower cavities.

* * * * *